US007621854B2

(12) United States Patent
Foxman

(10) Patent No.: US 7,621,854 B2
(45) Date of Patent: Nov. 24, 2009

(54) METHODS AND APPARATUS FOR CARDIOVASCULAR EXERCISING

(76) Inventor: Charles Foxman, 11945 Olive Blvd., St. Louis, MO (US) 63141

( * ) Notice: Subject to any disclaimer, the term of this patent is extended or adjusted under 35 U.S.C. 154(b) by 198 days.

(21) Appl. No.: 10/858,136

(22) Filed: Jun. 1, 2004

(65) Prior Publication Data

US 2005/0266965 A1 Dec. 1, 2005

(51) Int. Cl.
*A63B 5/20* (2006.01)
*A63B 5/22* (2006.01)

(52) U.S. Cl. ..... 482/82; 482/81

(58) Field of Classification Search ..... 482/81, 482/82; 446/247, 266, 307; 463/47.2, 47.5
See application file for complete search history.

(56) References Cited

U.S. PATENT DOCUMENTS

| | | | | | |
|---|---|---|---|---|---|
| 1,629,209 | A | * | 5/1927 | Fairbanks | 482/82 |
| 3,550,312 | A | * | 12/1970 | East | 446/247 |
| 4,179,119 | A | | 12/1979 | Wolf | |
| 4,330,118 | A | * | 5/1982 | Race | 482/82 |
| 4,563,002 | A | | 1/1986 | Jardine | |
| 4,733,861 | A | * | 3/1988 | Plunkett, III | 482/126 |
| 5,062,628 | A | * | 11/1991 | Heyn et al. | 482/81 |
| 5,549,532 | A | * | 8/1996 | Kropp | 482/126 |
| 5,697,871 | A | | 12/1997 | Landfair | |
| 5,746,687 | A | * | 5/1998 | Vial et al. | 482/126 |
| 5,842,956 | A | * | 12/1998 | Strachan | 482/82 |
| 5,895,341 | A | | 4/1999 | Jones | |
| 6,398,698 | B1 | * | 6/2002 | Hinds | 482/126 |
| 6,524,226 | B2 | * | 2/2003 | Kushner | 482/126 |
| 6,540,649 | B1 | * | 4/2003 | Niedrich | 482/82 |
| 6,692,415 | B1 | * | 2/2004 | Winston | 482/126 |
| 6,979,286 | B1 | * | 12/2005 | Hinds | 482/121 |
| 7,037,243 | B1 | | 5/2006 | Clancy | |
| 2003/0148859 | A1 | | 8/2003 | Chun | |
| 2005/0059532 | A1 | | 3/2005 | Huang | |
| 2006/0128534 | A1 | | 6/2006 | Roque | |

* cited by examiner

*Primary Examiner*—Loan H Thanh
*Assistant Examiner*—Allana Lewin
(74) *Attorney, Agent, or Firm*—Armstrong Teasdale LLP

(57) ABSTRACT

An exercise device includes a first member and a second member, wherein each member is fabricated from a non-elastic material and includes a first end, a second end, and a body extending therebetween. The exercise device also includes a first handle and a second handle, wherein the first handle is rotatably coupled to the first member body, and the second handle is rotatably coupled to the second member body such that each handle is slidable along each respective member body between the body first and second ends. The exercise device further includes a first handle stop and a second handle stop, each handle stop is coupled to a respective one of the member first ends for maintaining each handle in slidable contact with each respective member body.

19 Claims, 4 Drawing Sheets

METHODS AND APPARATUS FOR CARDIOVASCULAR EXERCISING

BACKGROUND OF THE INVENTION

This invention relates generally to exercising equipment, and more particularly to methods and apparatus for cardiovascular exercising.

At least some known forms of exercising facilitates improving a person's overall health. Jumping rope, for example, can facilitate improving a person's cardiovascular fitness, muscular endurance, and mental alertness. However, because of the coordination and concentration necessary to jump rope, it may be difficult for some people to jump rope continuously long enough to achieve such health benefits without tripping and/or having to stop and start jumping again. Accordingly, despite the numerous health benefits that may be afforded, many people find jumping rope too challenging and as such, may pursue other types of exercise.

To facilitate reducing an amount of coordination required to jump rope while still achieving the benefits of jumping rope, at least some jump rope equipment uses segmented or multi-piece ropes to facilitate preventing inadvertent contact between the rope and the person's head and feet. For example, U.S. Pat. No. 6,524,246 describes an apparatus which includes elastic bands fixedly secured to handles. However, such bands do not effectively simulate the non-elastic properties of a jump rope and/or the rotation of the rope within the handle, and as such, may adversely limit the benefits afforded to an exerciser using the equipment. For example, such equipment may not assist the exerciser in improving their overall coordination.

BRIEF DESCRIPTION OF THE INVENTION

In one aspect, an exercise device is provided. The exercise device includes a first member and a second member, wherein each member is fabricated from a non-elastic material and includes a first end, a second end, and a body extending therebetween. The exercise device also includes a first handle and a second handle, wherein the first handle is rotatably coupled to the first member body, and the second handle is rotatably coupled to the second member body such that each handle is slidable along each respective member body between the body first and second ends. The exercise device further includes a first handle stop and a second handle stop, each handle stop is coupled to a respective one of the member first ends for maintaining each handle in slidable contact with each respective member body.

In another aspect, a method of exercising is provided. The method comprises providing an exercise device including a first member and a second member that are each fabricated from a non-elastic material, wherein each member has a first end, a second end, and a body extending therebetween, and grasping each member using a handle that is rotatably coupled to each respective member body, wherein each respective handle is slidable along each respective member body between the first and second ends, and wherein at least one stop facilitates retaining each respective handle in slidable contact with each respective member body. The method also comprises rotating the first member in clockwise direction and the second member in a counter-clockwise direction such that a plane of rotation of each of the member second ends remain generally perpendicular to grade and generally parallel to an exerciser grasping the handles.

DETAILED DESCRIPTION OF THE INVENTION

Figure 1:
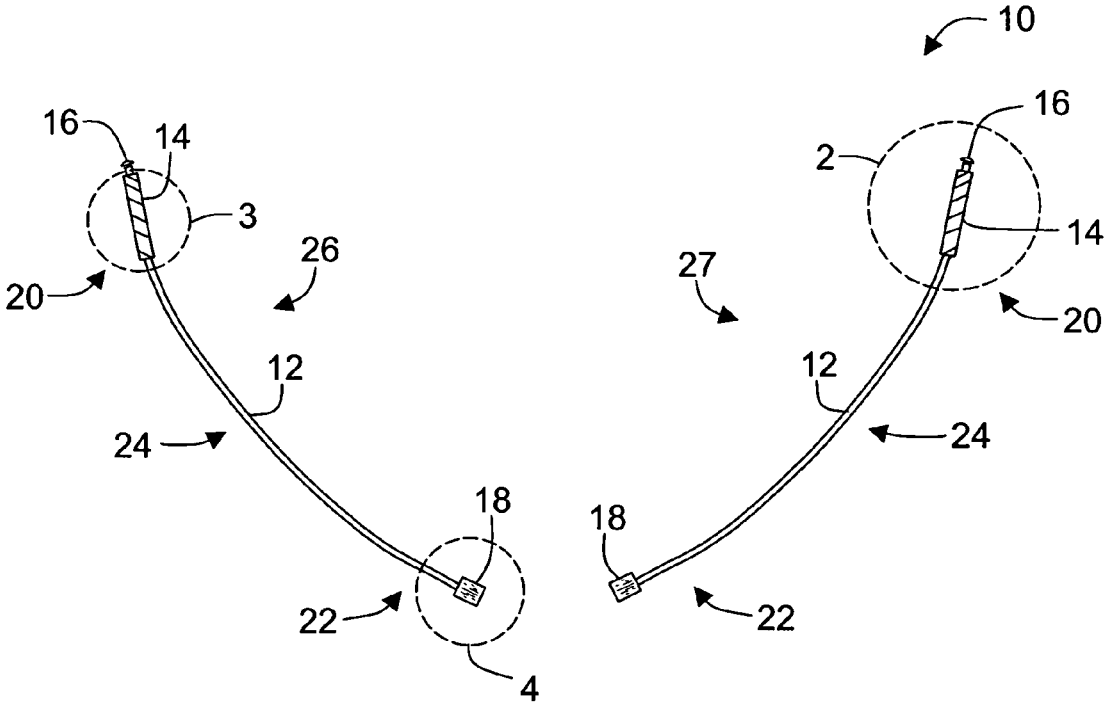
FIG. 1 is a schematic view of an exemplary exercise device.

FIG. 1 is a schematic view of an exemplary exercise device 10 including a pair of members 12, a pair of handles 14, a pair of handle stops 16, and a pair of end stops 18. Each member 12 includes a handle end 20, a rotatable end 22, and a body 24 extending therebetween. Each handle 14 is rotatably coupled to each body 24 such that each handle 14 is slidable along body 24 between ends 20 and 22. Each handle stop 16 is coupled to each handle end 20 for maintaining each handle 14 in slidable contact with body 24. Each handle stop 16 is configured to retain each handle 14 to body 24. Exercise device 10 also includes a first exercise member 26 and a second exercise member 27. Members 26 and 27 are separate and independent.

Figure 2:
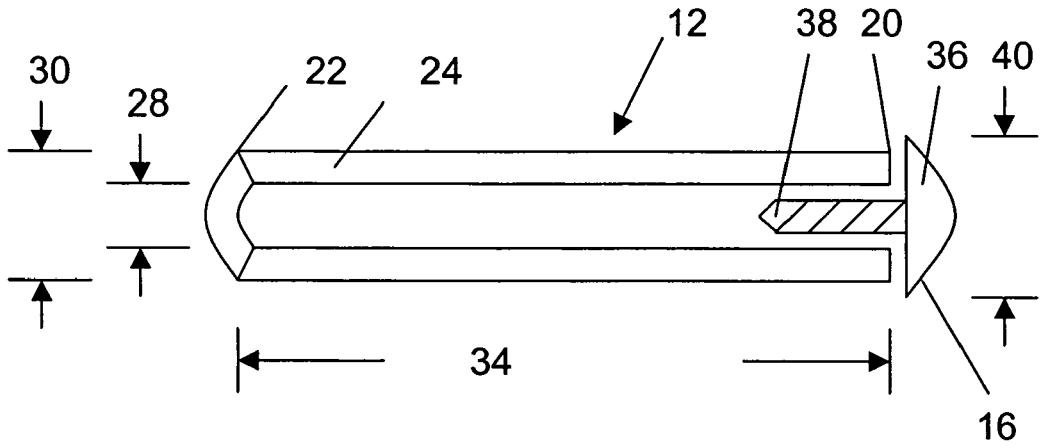
FIG. 2 is an enlarged cross-sectional view of a portion of the exercise device shown in FIG. 1 and taken along area 2.

FIG. 2 is an enlarged cross-sectional view of a portion of member 12 shown in FIG. 1. Member 12 is substantially cylindrical and is fabricated from a non-elastic material that is flexible. In the exemplary embodiment, member 12 is tubular. In one embodiment, member 12 is fabricated from a synthetic material having a relatively high resilience. In another embodiment, member 12 is extruded from a nylon blend material. In a further embodiment, member 12 is extruded from a material, such as, but not limited to a vinyl material, a polyester material, and/or a polypropylene material. The material selected for fabricating each member 12 is selected to facilitate enabling member 12 to be cut by non-commercial cutting devices, such as, but not limited to, a pair of scissors.

Body 24 has an outer diameter 28 and an inner diameter 30. Outer diameter 28 and inner diameter 30 are substantially constant throughout body 24. In one embodiment, body outer diameter 28 is approximately equal to 0.25 inches and inner diameter 30 is approximately equal to 0.09375 inches. Inner diameter 30 is sized to receive a handle stop 16 therein. Body 24 has a length 34 measured between handle end 20 and rotatable end 22. In one embodiment, length 34 is approximately equal to 24.0 inches. Length 34 as described in more detail below, is adjustable.

Each handle stop 16 includes a head portion 36 and a coupling portion 38. Each head portion 36 has a diameter 40 that is larger than member outer diameter 28. Accordingly, head portion 36 is sized to limit an insertion depth of handle stop 16 within member 12. In one embodiment, head portion diameter 40 is approximately equal to 0.3125 inches.

Figure 3:
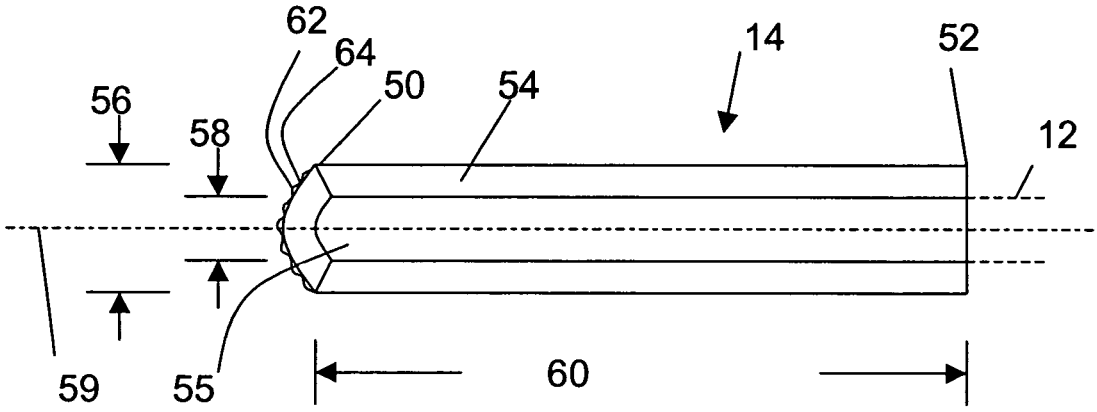
FIG. 3 is an enlarged cross-sectional view of a portion of the exercise device shown in FIG. 1 and taken along area 3.

Handle stop coupling portion 38 is sized to be at least partially coupled within member 12. More specifically, each handle stop 16 is removably coupled to each respective handle end 20 to facilitate retaining handle 14 to member 12 and to facilitate adjusting length 34. In one embodiment, each handle stop 16 is a screw. In another embodiment, handle stop 16 is coupled to member 12 using any suitable means that enables stop 16 to function as described herein FIG. 3 is an enlarged cross-sectional view of handle 14. Handle 14 includes a first end 50, a second end 52, and a handle body 54 extending therebetween. Handle 14 is cylindrical and hollow such that an opening 55 extends substantially concentrically therethrough. In one embodiment, handle 14 has any shape that enables handle 14 to function as described herein. Handle 14 is substantially rigid and in one embodiment is fabricated from a material having high strength and resilience properties. In one embodiment, handle 14 is extruded from a nylon blend material. In another embodiment, handle 14 is extruded from a material, such as, but not limited to a vinyl material, a polyester material, and/or a polypropylene material.

Handle 14 is slidably and rotatably coupled to member 12. Handle body 54 has an outer diameter 56, an inner diameter 58, and a center axis of symmetry 59 extending therethrough such that each handle 14 is substantially concentrically aligned with each respective member 12. Outer diameter 56 and inner diameter 58 are substantially constant throughout body 54. Body 54 has a length 60 measured between first end 50 and second end 52. Inner diameter 58 is larger than member outer diameter 28 such that handle 14 is rotatable about, and slidable along, the entire length 34 of member 12 between each ends 20 and 22. Additionally, member 12 is rotatable within handle 14 along the entire handle length 60.

Handle inner diameter 58 is smaller than end stop head portion diameter 40 such that handle 14 contacts handle stop 16 at member handle end 20. Accordingly, handle stop 16 prevents handle 14 from un-coupling from member 12 during use. In one embodiment, body outer diameter 56 is approximately equal to 0.5 inches and inner diameter 58 is approximately equal to 0.25 inches. In one embodiment, handle length 60 is approximately equal to 4.5 inches.

In the exemplary embodiment, handle body 54 includes a plurality of ridges 62 equally spaced circumferentially about body 54 and across an exterior surface 64 of body 54. Ridges 62 extend longitudinally along length 60 of handle 14. Ridges 62 facilitate increasing the gripping surface area and thus facilitate preventing slippage during use.

Figure 4:
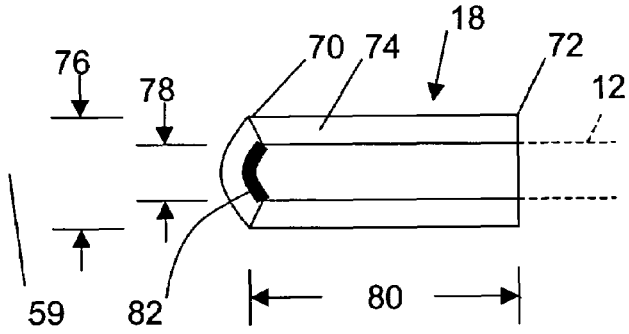
FIG. 4 is an enlarged cross-sectional view of a portion of the exercise device shown in FIG. 1 and taken along area 4.

FIG. 4 is an enlarged cross-sectional view of end stop 18. Each end stop 18 includes a first end 70, a second end 72, and a body 74 extending therebetween. In the exemplary embodiment, each end stop 18 is a hollow sleeve that is coupled to and extends circumferentially around each member 12. In one embodiment, end stop 18 is cylindrically shaped. In another embodiment, end stop 18 has any shape that enables end stop 18 to function as described herein. In the exemplary embodiment, end stop 18 is fabricated from a foam or cellular material and has a nominal weight and a modulus of elasticity that is greater than a corresponding modulus of elasticity of member 12. In one embodiment, each end stop 18 is extruded from a polyester material. In another embodiment, each end stop 18 is extruded from a material, such as but not limited to a polyether material, a polyethylene material, and/or a polyvinyl chloride (PVC) material. The material selected for fabricating each end stop 18 is selected to facilitate enabling end stop 18 to lessen or cushion an impart, to absorb a sudden shock, and to resist deformation.

Each end stop 18 is coupled to a respective rotatable end 22 for maintaining each handle 14 in slidable contact with member body 24. Body 74 has an outer diameter 76 and an inner diameter 78. Body 74 also has a length 80 measured between first end 70 and second end 72. Body outer diameter 76 is greater than handle inner diameter 58. Accordingly, each end stop 18 is sized to retain each handle 14 to member 12. Outer diameter 76 and inner diameter 78 are substantially constant throughout body 74. In one embodiment, body outer diameter 76 is approximately equal to one inch and inner diameter 78 is approximately equal to 0.25 inches. In one embodiment, length 80 is approximately equal to 1.5 inches. Inner diameter 78 is sized to enable each end stop 18 to be secured to member rotatable end 22 such that end stop body second end 72 is adjacent to member rotatable end 22.

Each end stop 18 may be secured to member rotatable end 22 by an adhesive resin 82. In one embodiment, adhesive resin 82 is an adhesive, such as, but not limited to an epoxy, a urethane, and a silicon.

Figure 5:
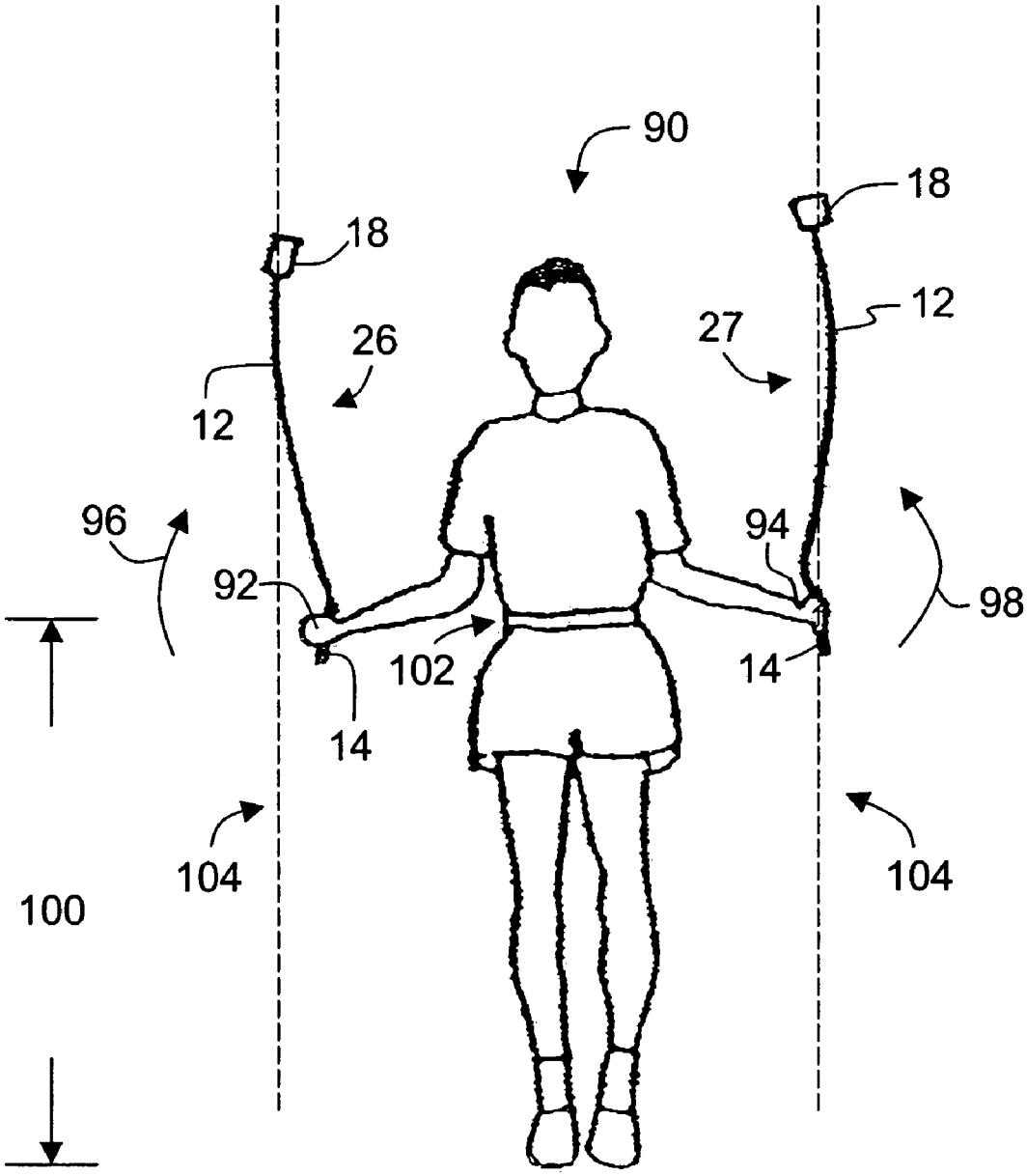
FIG. 5 is an exemplary view of a person exercising using the exercise device shown in FIG. 1.

FIG. 5 is prospective view of a person exerciser 90 exercising using exercise device 10. Exerciser 90 grasps each respective handle 14 within of their hands 92 and 94. First rope 26 is rotated in a clockwise direction 96 while simultaneously rotating second rope 26 in a counter-clockwise direction 98. Hands 92 and 94 are positioned at a height 100 adjacent the user's waist 102. Exercise device 10 is rotated such that ends 22 are rotated in small circles. During rotation, each member 12 rotates within slidable handle 14 and end stop 18 rotates in a vertical plane 104 adjacent to exerciser 90. With each rotation of ropes 24 and 26, exerciser 90 jumps in manner simulating jumping rope. Alternatively, the direction of rotation maybe reversed such that exerciser 90 simulates jumping rope backwards.

Several variations of jumping, skipping, and jogging may also be performed. Exerciser 90 may vary the height of jumping as well as vary the positioning of the feet. Exerciser 90 may jump with both feet striking the ground together or alternate between each foot. Additionally, exerciser 90 may jump with both feet together and move his feet from side-to-side imitating a skier moving down a slope or jump with both feet apart and move his feet from front to back imitating a pair of scissors. Furthermore, exerciser 90 can open and close his feet imitating jumping jacks or move his feet in a running fashion imitating running in place.

Exercise device 10 is configured to be adjustable such that it may be sized to accommodate the height of exerciser 90. For example, exerciser 90 may be a child, an adult, or a person confined to a wheelchair. Specifically, length 34 may be shortened. To shorten length 34, exerciser 90 removes each handle stop 16 from each member handle end 20, shortens length 34 by removing equal portions (not shown) of handle end 20 to a desired length, and re-coupling handle stop 16 to handle end 20. The portions may be removed by cutting or by using any means capable of removing equal portions of member 12.

Figure 6:
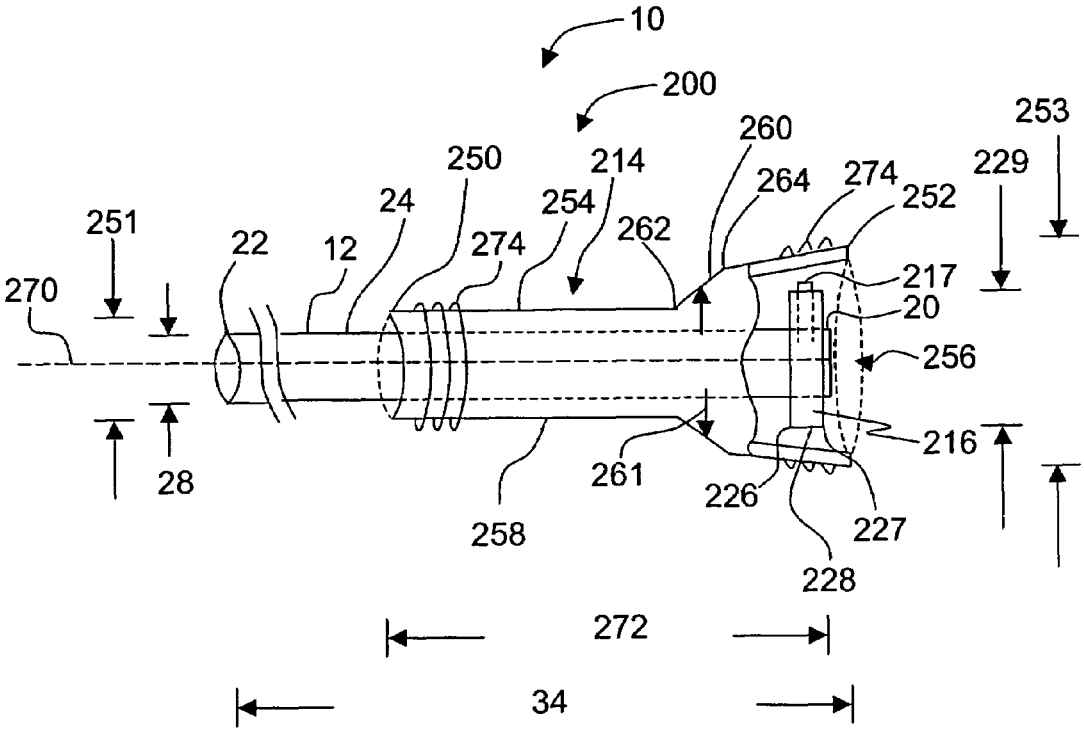
FIG. 6 is an enlarged cross-sectional view of a portion of an alternative embodiment of the exercise device shown in FIG. 1 and taken along area 2.

FIG. 6 is an enlarged cross-sectional view of a portion of an alternative embodiment of an exercise device 200. Exercise device 200 is substantially similar to exercise device 10 shown in FIG. 1-5, and components of exercise device 200 that are the same as those of exercise device 10 are identified in FIG. 6 using the same reference numbers used in FIGS. 1-5. Accordingly, exercise device 200 includes a pair of members 12, a pair of handles 214, a pair of handle stops 216, and a pair of end stops 18 (not shown in FIG. 6). Each handle 214 is rotatably coupled to each member body 24 such that each handle 214 is slidable along body 24 between member ends 20 and 22. Each handle stop 216 is coupled to each handle end 20 for maintaining each handle 214 in slidable contact with body 24.

Each handle stop 216 is formed of a body portion 228 that extends between a pair of outer ends 226 and 227. In the exemplary embodiment, each handle stop 216 is a hollow sleeve that is coupled to each member end 20. In an alternative embodiment, handle stop 216 has a toroidal cross-section shape shaped. In a further alternative embodiment, handle stop 216 has any shape that enables handle stop 216 to function as described herein. In the exemplary embodiment, Handle stop 216 has a width 229 that enables handle stop 216 to be at least partially received within each respective handle 214, as described in more detail below. More specifically, each handle stop 216 is sized to facilitate retaining each handle 214 to each member 12.

In the exemplary embodiment, each handle stop 216 is secured to a respective member 12 by a fastener 217. In the exemplary embodiment, fastener 217 is a staple. In alternative embodiment, handle stop 216 is secured to member 12 by an adhesive. In a further alternative embodiment, handle stop 216 is coupled to member 12 using any suitable means that enables stop 216 to function as described herein.

In the exemplary embodiment, handle stop 216 is fabricated from a synthetic material having a relatively high resilience. In another embodiment, handle stop 216 is extruded from a nylon blend material. In a further embodiment, handle stop 216 is extruded from a material, such as, but not limited to a vinyl material, a polyester material, and/or a polypropylene material.

Handle 214 is hollow and includes a first end 250, a second end 252, and a handle body 254 extending therebetween. First end 250 has an outer diameter 251 and second end 252 has an outer diameter 253, each being measured with respect to an outer surface 258 of handle 214. Diameter 251 is smaller than diameter 253. First end diameter 251 is wider than member body diameter 28.

Body 254 defines a cavity 256 therein. Cavity 256 includes a throat portion 260 that extends between a first end 262 and a second end 264. Throat 260 has an inner diameter 261 measured between throat ends 262 and 264. As such, cavity 256 is sized to receive handle stop 216 therein, and the decreasing diameter 261 of cavity 256 limits an insertion of depth of handle stop 216. More specifically, throat diameter 261 is smaller than handle stop width 229. As such, throat 260 prevents handle stop 216 from sliding through cavity 256. Accordingly, handle stop 216 prevents handle 214 from uncoupling from member 12 during use.

In another alternative embodiment, cavity 256 has a uniform inner diameter (not shown) and a annular ring (not shown), wherein the uniform inner diameter is sized to receive handle stop 216 and the annular is sized contact handle stop 216. In a further alternative embodiment, cavity 256 has a plurality of inner diameters (not shown) wherein at least one of the inner diameters is sized contact handle stop 216.

Handle 214 is substantially rigid and in one embodiment is fabricated from a material having high strength and resilience properties. In one embodiment, handle 214 is extruded from a nylon blend material. In another embodiment, handle 214 is extruded from a material, such as, but not limited to a vinyl material, a polyester material, and/or a polypropylene material.

Each handle 214 is slidably and rotatably coupled to each respective member 12. Handle 214 has a center axis of symmetry 270 extending therethrough such that each handle 214 is substantially concentrically aligned with each respective member 12. Handle 214 has a length 272 measured between first end 250 and second end 252. Handle 214 is rotatable about, and slidable along, the entire length 34 of member 12 between each ends 20 and 22. Additionally, member 12 is rotatable within handle 214 along the entire handle length 272.

In the exemplary embodiment, handle 214 includes a plurality of ridges 274 extending across outer surface 258 of first end 250 and second end 252. In the exemplary embodiment, ridges 274 are equally-space circumferentially about outer surface 258. Ridges 274 facilitate increasing the gripping surface area and thus facilitate preventing slippage during use.

The above-described exercise device is cost-effective and durable. The exercise device includes a pair of exercising members that enables a user to simulate jumping rope while reducing inadvertent contact typically associated with known jump ropes. Each exercise device includes a pair of members fabricated from a non-elastic, flexible material. The exercise device also includes a pair of handles that rotate during exercising and are slidable along the entire length of each member. The exercise device also includes a pair of end stops fabricated from a hollow, cellular material that facilitates lessening or cushioning any inadvertent contact occurring between the exerciser and the exercise device.

As a result, the exercise device may be used to exercise a plurality of muscles including but no limited to the muscles located in the arms, shoulders, back, chest, legs, and buttocks. Use of the exercise device facilitates learning essential jumping rope skills and increasing cardiovascular fitness, muscular endurance, and mental alertness.

Exemplary embodiments of the exercise device are described above in detail. The exercise device is not limited to the specific embodiments described herein, but rather, components may be utilized independently and separately from other components described herein. Each exercise device component can also be used in combination with other exercise device components. Furthermore, each exercise device component may also be used with other configurations of exercise devices.

While the invention has been described in terms of various specific embodiments, those skilled in the art will recognize that the invention can be practiced with modification within the spirit and scope of the claims.

What is claimed is:

1. An exercise device comprising:

a first flexible member;

a second flexible member, each said member fabricated from a non-elastic material and comprising a first end, a second end, and a body extending therebetween;

a first handle;

a second handle, said first handle rotatably coupled to said first member body, and said second handle rotatably coupled to said second member body such that each said handle is slidable along each respective said member body between said body first and second ends, each said handle comprises a throat that is spaced a distance from an end of said handle, said throat having a cross-sectional profile defined by a first diameter at a first end and a second diameter at a second end, wherein the second diameter is a different size than the first diameter;

a first handle stop;

a second handle stop, each said handle stop comprises a first portion directly attached to and extending from a second portion, said second portion is aligned generally axially with each of said first and second flexible member first ends such that said second portion is substantially concentrically aligned with respect to at least one of said first and second flexible members, each of said handle stops facilitates maintaining each of said handles in slidable contact with each of said member bodies, each of said throats is configured to contact a respective said handle stop, wherein at least one of the first diameter and the second diameter is less than a width of each said handle stop;

a first end stop; and a second end stop, each said end stop has nominal weight and is coupled to a respective one of said member second ends such that said first handle is freely slidable along said first member body between said first handle stop and said first end stop, and said second handle is freely slidable along said second member body between said second handle stop and said second end stop.

2. An exercise device in accordance with claim 1 wherein each said member is tubular and flexible.

3. An exercise device in accordance with claim 1 wherein each said handle stop is removably coupled to each respective said pair of member.

4. An exercise device in accordance with claim 1 wherein each said handle stop is fixedly coupled to each respective said pair of member.

5. An exercise device in accordance with claim 1 wherein each said handle stop comprises a threaded fastener.

6. An exercise device in accordance with claim 1 wherein each said end stop extends radially outwardly a distance from each respective said member.

7. An exercise device in accordance with claim 6 wherein each said end stop is fabricated from a material that facilitates cushioning an impact imparted of each said end stop to a user of said exercise device.

8. An exercise device in accordance with claim 6 wherein each said end stop is fabricated from a cellular material.

9. An exercise device in accordance with claim 6 wherein each said end stop comprises a hollow foam sleeve.

10. An exercise device in accordance with claim 6 wherein each said end stop is coupled to each said member second end by an adhesive.

11. An exercise device in accordance with claim 1 wherein each said handle comprises a center axis of symmetry extending therethrough, each said handle is substantially concentrically aligned with respect to each said member.

12. An exercise device in accordance with claim 1 wherein each said handle comprises an opening extending substantially concentrically therethrough, each said handle opening having a diameter that is larger than a diameter of each of said members.

13. A method of exercising comprising:

providing an exercise device including a first flexible member and a second flexible member, wherein the second member is separated from and is not coupled to the first member, each member is fabricated from a non-elastic material, and each member has a first end, a second end, and a body extending therebetween;

grasping each member using a handle that is rotatably coupled to each respective member body, wherein each handle includes a throat that is spaced a distance from an end of the respective handle, wherein at least one handle stop and at least one end stop having nominal weight is coupled to each respective member body, and wherein the at least one handle stop includes a first portion extending from a second portion that is at least partially inserted generally axially within each respective first and second flexible member first end such that the second portion is substantially concentrically aligned with respect to at least one of the first and second flexible members, the at least one handle stop facilitates maintaining each respective handle in slidable contact with each respective member body, wherein each throat is configured to contact the respective handle stop, wherein an end of each throat has a diameter that is less than a width of the respective handle stop; and rotating the first member in clockwise direction and the second member in a counter-clockwise direction such that a plane of rotation of each of the member second ends remain generally perpendicular to grade and generally parallel to an exerciser grasping the handles.

14. A method in accordance with claim 13 wherein providing an exercise device including a first and a second member further comprises adjusting a length of each member by:

removing a handle stop from each respective member;

shortening a length of each member to a desired length; and re-coupling each respective stop to each respective member.

15. A method in accordance with claim 13 wherein providing an exercise device including a first and a second member further comprises providing an exercise device wherein each end stop is fabricated from a material that is configured to cushion an inadvertent impact of said second end to the exerciser.

16. A method in accordance with claim 13 wherein providing an exercise device including a first and a second member further comprises providing an exercise device wherein each end stop is fabricated from a cellular material.

17. A method in accordance with claim 13 wherein providing an exercise device including a first and a second member further comprises providing an exercise device wherein each end stop is fabricated from a hollow foam sleeve.

18. An exercise device in accordance with claim 1 wherein said first handle is a unitary member, and wherein said second handle is a unitary member.

19. An exercise device comprising:

a first flexible member;

a second flexible member, each said member is fabricated from a non-elastic material and comprises a first end, a second end, and a body extending therebetween;

a first hollow handle;

a second hollow handle, said first handle is rotatably coupled to said first member body, and said second handle rotatably coupled to said second member body such that each said handle is slidable along each respective said member body between said body first and second ends, each said handle has an inner diameter and an outer diameter that is larger than said inner diameter;

a first handle stop;

a second handle stop, each of said handle stops facilitates maintaining each of said handles in slidable contact with each of said member bodies, each said handle stop comprises a first portion and a second portion that extends from said first portion, said first portion has a width that is wider than said handle inner diameter such that said first portion is not insertable into each of said handles when said second portion is at least partially inserted generally axially into each of said first and second flexible member first ends;

a first end stop; and a second end stop, each said end stop is coupled to a respective one of said member second ends such that said first handle is slidable along said first member body between said first handle stop and said first end stop, and said second handle is slidable along said second member body between said second handle stop and said second end stop.

* * * * *